United States Patent [19]

Simpson

[11] 4,058,026

[45] Nov. 15, 1977

[54] MECHANICAL ACTUATION SIMULATOR

[76] Inventor: Norman K. Simpson, 1770 C Industrial Road, Las Vegas, Nev. 89102

[21] Appl. No.: 679,998

[22] Filed: Apr. 26, 1976

[51] Int. Cl.[2] ..... G05G 1/04

[52] U.S. Cl. ..... 74/577 R; 74/577 M; 194/DIG. 11

[58] Field of Search ..... 74/577 R, 577 M, 523; 194/DIG. 11

[56] References Cited

U.S. PATENT DOCUMENTS

| | | | |
|---|---|---|---|
| 467,297 | 1/1892 | McLaughlin | 74/577 M X |
| 2,577,199 | 12/1951 | Klopner | 74/577 M |

*Primary Examiner*—Edgar W. Geoghegan
*Attorney, Agent, or Firm*—Seiler & Quirk

[57] ABSTRACT

In an electrically operated dispensing machine in which actuation is initiated by pulling a handle, the improvement comprises a device for simulating mechanical actuation by pulling the handle, the device comprising a ratchet member having a toothed surface and a member engaging the toothed surface as the handle is pulled, the engagement simulating a mechanical actuation.

4 Claims, 4 Drawing Figures

MECHANICAL ACTUATION SIMULATOR

BACKGROUND OF THE INVENTION

Many dispensing machines, generally of the coin operated type, in which a coin is inserted and a handle is pulled to actuate the machine, no longer use mechanical actuation but instead are electronically operated. Such apparatus include vending machines, change machines and the like. Particularly affected machines are coin operated gaming machines of the type described in U.S. Pat. Nos. 3,285,380 and 3,273,571 in which the pay-out is determined by random positions of movable mechanical components such as wheels or rotating discs. Such mechanisms are well known to those skilled in the art and are often referred to as slot machines. Such machines may actually distribute coins themselves or may simply be used for entertainment for giving away prizes, depending on the final position of the rotating discs, usually having various designs, marks, figures, or pictures thereon which are visible to the player.

Older machines of this type incorporate mechanical actuation by pulling a spring loaded handle of the machine, which, through a series of gears, levers and/or similar mechanical components, actuate or spin the discs. In many of such prior machines, the rate and time of disc rotation is determined by the force and speed used by the operator in pulling the handle. Such mechanical devices gave the operator the feeling of at least partially contributing to and determining or selecting winning combination on the discs, depending on the force applied to the handle during the pull actuation of the apparatus. In the later developed electrically operated and actuated devices of this type, the handle pull simply closes a switch or the like which initiates operation of the apparatus. Although the handle may be biased by a spring or the like to resist the pull of the operator, with the mechanical actuation components removed, there is no "feel" of meshing gears, detents, ratchets or the like and with only actuation of a switch at the end of the handle pull there is little if any operator satisfaction of contributing to or influencing the selection of a winning combination.

SUMMARY OF THE INVENTION

It is an object of the invention to provide a device for simulating mechanical actuation in an electrically actuated vending or dispensing machine including coin operated gaming machines. It is a further object to provide a simple mechanical simulating device in an electrically actuated vending, dispensing or gaming machine which produces sound and feel of a mechanically actuated machine. The device of the present invention which accomplishes these objects is rugged, has relatively few components, and provides a desired sound and feel of a mechanical actuated handle pull apparatus without affecting the electric actuation or operation of the machine to which it is attached in any substantial way. The accomplishment of the objects as well as others will become more evident and better understood from the following detailed description.

DETAILED DESCRIPTION OF THE INVENTION

Figure 1:
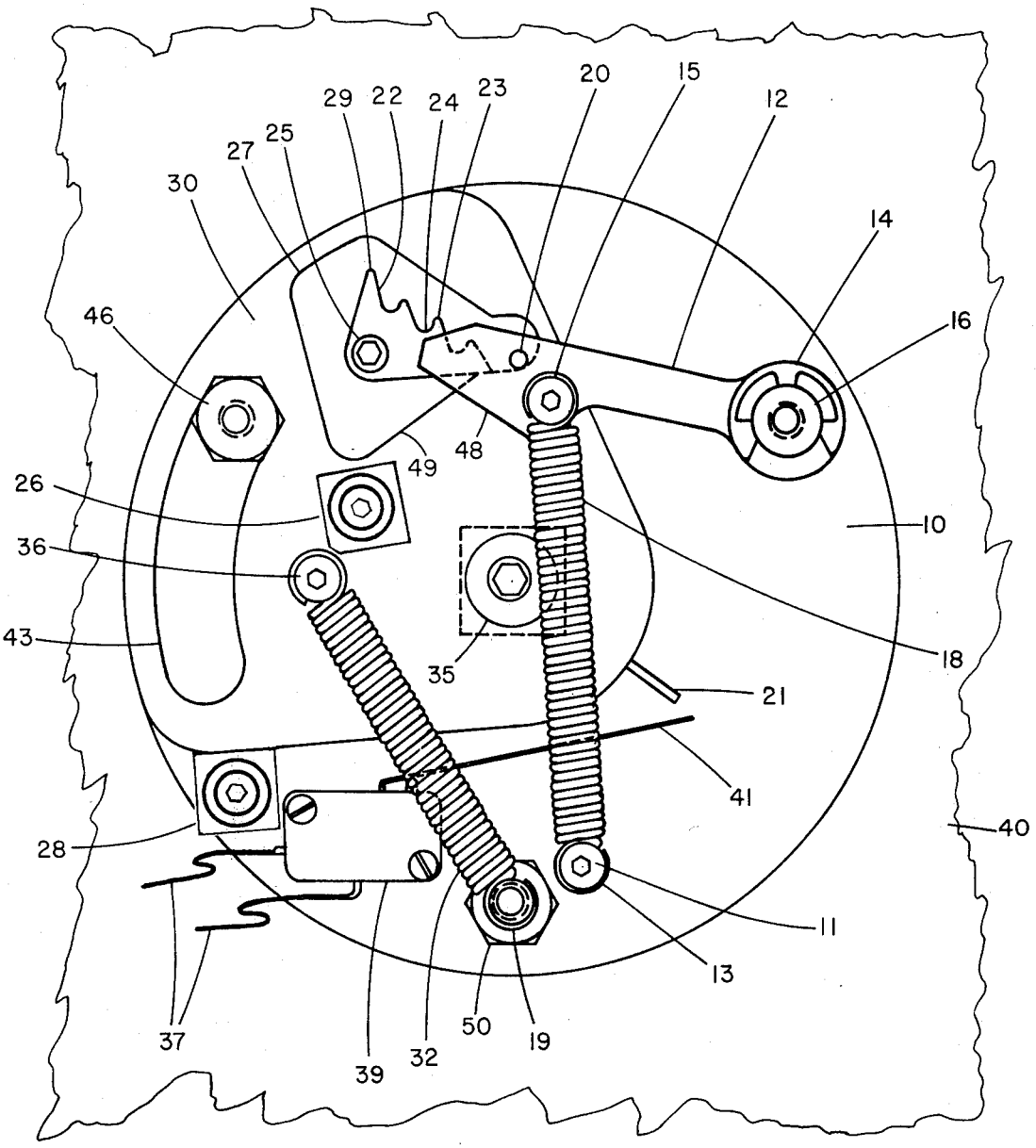
FIG. 1 is an elevational view of the assembly of the present invention in its normal rest position prior to handle pull.
Figure 4:
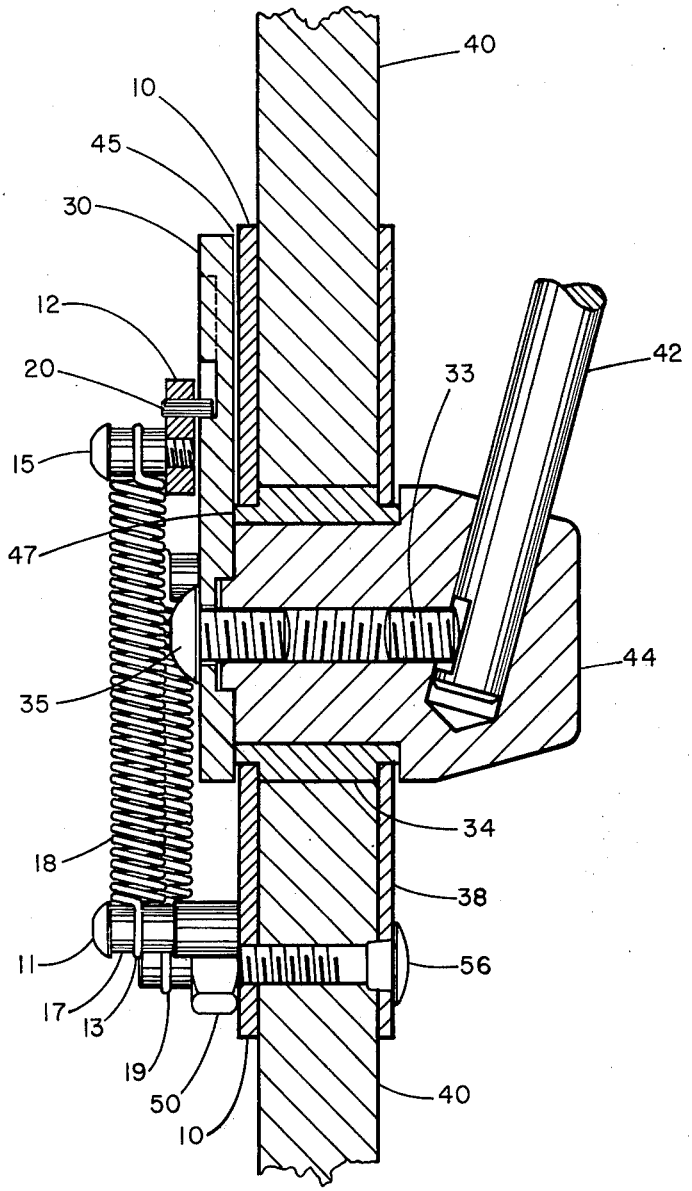
FIG. 4 is a sectional elevation of the assembly shown in FIG. 1.

FIGS. 1 and 4 show the apparatus, FIG. 1 being a side elevational view and FIG. 4 a sectional view of the assembly mounted in a cabinet. Inside mounting plate 10 is secured on cabinet side wall 40 utilizing mounting bolt 56 which also extends through and secures outside mounting plate 38. Nut 50 threadedly engages the mounting bolt to firmly secure the inside and outside plates to the cabinet wall. Also secured to the cabinet wall is a hub 44 and bearing or bushing 34 on which the hub rotates and to which hub handle 42 is securely mounted by set screw 33. The hub is also securely mounted to the apparatus by set screw 35 having an enlarged button head which is urged against plate 30 when the screw is tightened into the hub. Set screw 35 may also be replaced by a bolt or other member which will threadedly engage the hub and secure plate 30. The latter will hereinafter be referred to as the "action plate" since it rotates or pivots on set screw 35 as the handle is pulled by an operator during actuation of the apparatus.

Figure 2:
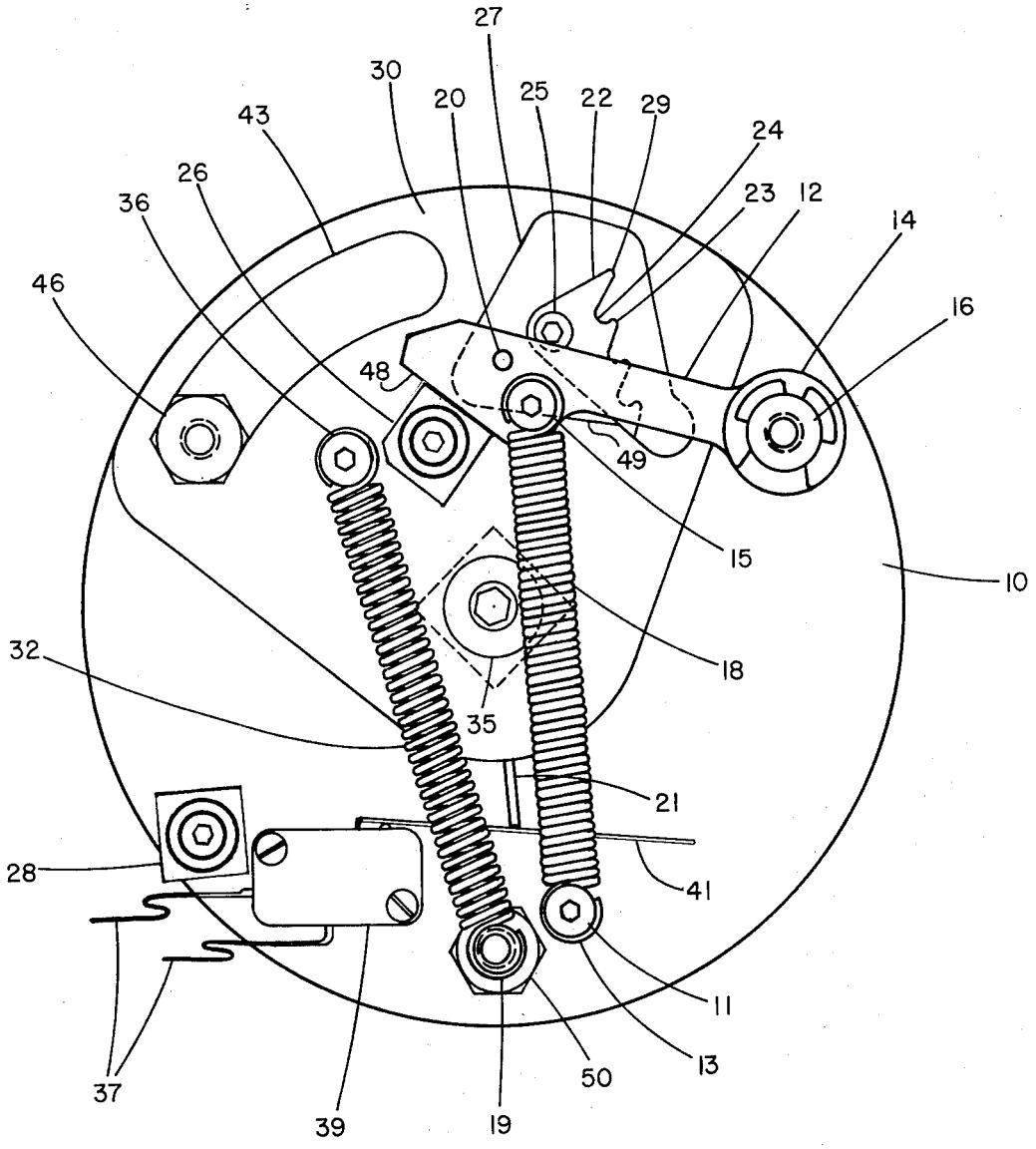
FIG. 2 is an assembly of FIG. 1 with the handle in the fully pulled or displaced position.

Action plate 30 is mounted so that it can rotate in an arc from left to right as FIGS. 1 and 2 are observed. FIG. 1 shows the plate in a rest position to which it is urged by action plate return spring 32. The fully displaced position is shown in FIG. 2 with the handle fully pulled to the end of its travel to actuate the apparatus. A space 45 shown in FIG. 4 illustrates the fit or separation between action plate 30 and inside mounting plate 10 to reduce or obviate significant friction. Hub bearing 34 extends inwardly slightly from inside mounting plate 10 to meet the action plate at surface 47.

The action plate 30 has an arc shaped slot 43 in which is received nut 46 which acts as a stop at both ends of the arc movement of the action plate. The nut is secured to inside mounting plate 10 by a bolt or any other suitable means. The action plate is also provided with a cavity 27 which does not extend entirely through the thickness of the plate but only to a depth sufficient to receive ratchet pawl 22. The pawl is flat and is pivotally mounted to the action plate by pivot pin 25 which is secured to the action plate. The size of cavity 27 is such as to allow for movement of the ratchet pawl in the manner as will be described further hereinafter.

Action plate return spring 32 is mounted between the action plate and the inside mounting plate. The upper end of spring 32 is secured on a sleeve to screw 36 which threadedly engages action plate 30 and the lower spring end is secured to the nut 50. It will be noted that the end of the spring 32 is formed so as to provide a clip 19 for being secured on the bolts or sleeves. With the action plate return spring so mounted, it will be evident that it urges or pulls the action plate, and concomitantly the handle, to stop position shown in FIG. 1, with the end of action plate slot 43 resting against stop nut 46. Bumper 28 is also provided to cushion the action plate when it is returned to the stop position upon release of the handle. This bumper pad may be in the form of any cushioning material such as a rubber or other resilient compositions, and is secured to inside mounting plate 10 by a screw or any other suitable means, and is properly positioned so that the lower surface or edge of the action plate contacts the bumper pad at approximately the same time the upper end of slot 43 contacts stop nut 46. The purpose of the bumper is only to provide a cushion when the action plate returns to its stop position shown in FIG. 1 and to reduce the metal to metal contact of the plate surface at the slot end with stop nut 46 and thus also reduce wear and noise when an operator releases the handle rather than moving it gently to the start position.

Also pivotally secured on the inside mounting plate is ratchet pawl arm 12, having one end mounted on pivot nut 16. The nut will pass through a hole in the end of the arm and a spring end clip 14 and a washer as shown in FIG. 1 may also be used. Near the opposite end of the arm is a pin 20, which may be received in a slightly oversized notch cut into the arm, or it may be fixed to the arm. The pin is long enough so as to extend into cavity 27. The purpose for the pin is to engage the ratchet surface of pawl member 22. This engagement occurs as the action plate pivots on screw 35 when the handle is pulled whereby ratchet pawl 22 is moved to the right as FIG. 1 is observed. Once the ratchet pawl is moved sufficiently, it contacts pin 20 which extends into cavity 27. As the action plate and pawl are further moved during handle pull, the pin 20 engages the ratchet surface, successively rising on ridges 23 and falling into the notches or detents 24. Since the arm is pivoted it will alternately rise and fall as the pin successively engages the components of the ratchet pawl surface. Ratchet pawl arm 12 is also biased downwardly by damper spring 18 which is secured to the arm at upper socket screw 15 while the lower spring end is secured to the mounting plate by lower socket screw 11. Accordingly, the spring acts to bias the arm downwardly and which bias is overcome as pin 20 overrides the ridges 23 of the ratchet surface on the pawl 22. It is this movement of the pin 20 over the pawl ratchet surface that provides the mechanical handle pull simulation feature of the invention. The action and sharp clicks of pin 20 riding successively over the ridges 23 and driven into the notches or detents 24 is translated through the handle and is felt as well as heard by the operator as the handle is pulled.

Also secured on action plate 30 is a bumper pad 26 but which provides cushioning at the end of the travel of the action plate as the handle is pulled fully. This cushioning is realized when the action plate is moved in its arc-shaped travel pattern to the right, whereby slot 43 moves circumferentially around the action plate pivot point of screw 35 until the lower slot end meets stop nut 46. At the same time, upper pad 26 is moved until it meets end surface 48 of arm 12 as shown in FIG. 2, again providing a cushioned stop of the handle and action plate travel. However, the bumper pads are optional.

An actuator arm 21 is secured on the action plate so that as the plate turns on pivot 35, arm 21 moves downwardly until it meets lever 41 of microswitch 39. As the action plate is pivoted fully to the actuation or stop position shown in FIG. 2, with the handle 42 pulled fully forward by an operator, depression of lever 41 will actuate the micro-switch thereby closing the electronic circuit through conductors 37 which will then cause actuation of the apparatus. Preferably, arm 21 threadedly engages the action plate so that adjustment of the arm length can be made to provide for earlier or later micro-switch closing as the arm is shortened or lengthened as desired.

Figure 3:
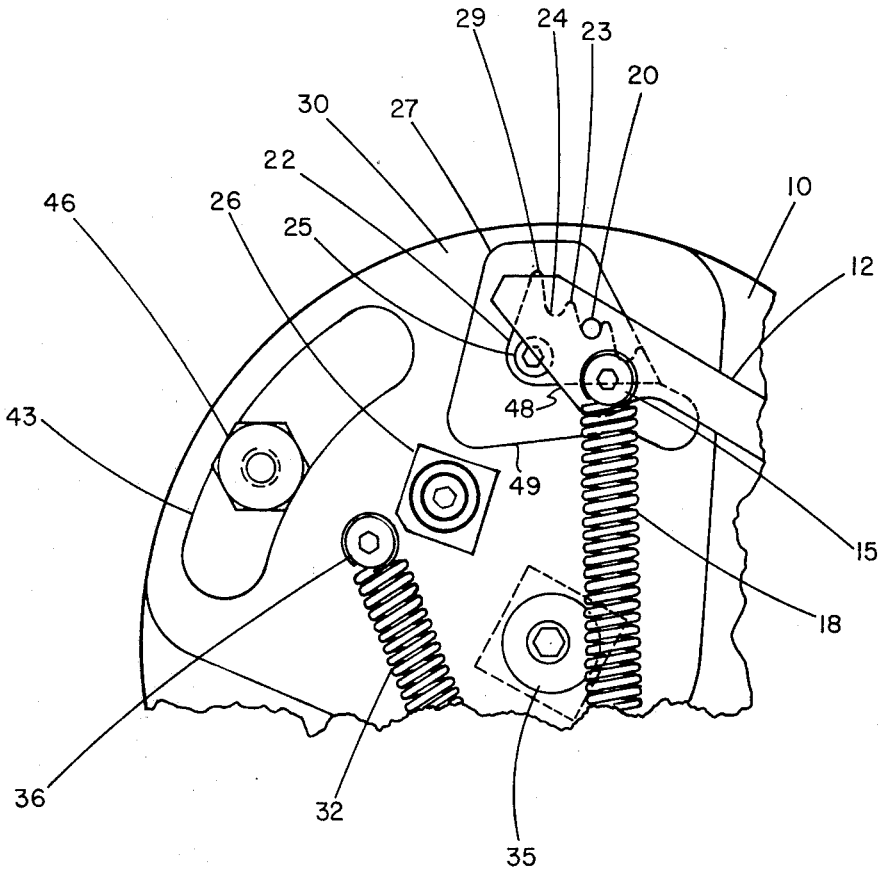
FIG. 3 is a partial view of the assembly illustrating components thereof in a position intermediate of those shown in FIGS. 1 and 2.

Observing now also FIG. 3, there is illustrated ratchet pawl 22 and a portion of action plate 30 and their relationships with ratchet pawl arm 12 and pin 20 in an intermediate position. As shown, the action plate is approximately half way through its arc-shaped travel, with stop nut 46 about half way or intermediate in slot 43. The action plate and ratchet pawl have been moved to the right so that pin 20 is about half way along the ratchet surface. A portion of the pawl is shown in phantom so as to illustrate its relationship with arm 12.

Observing also FIG. 2, as the handle of the apparatus is continually pulled, pin 20 passes over the remainder of the ratchet surface, finally passing over end ridge 29 whereupon the arm is pulled downwardly until the pin meets the bottom of cavity 27, again, due to the bias of damper spring 18. As the handle of the apparatus is then released by the operator, action plate 30 returns to its start position shown in FIG. 1, with pin 20 sliding along surface 49 of cavity 27. The pawl pivots on pivot pin 25 as pin 20 passes between the cavity and pawl surfaces. The device is then in the start position so that the operator can pull the handle for repeating the sequence described.

It will be understood that during the handle pull sequence with pin 20 successively passing through the ratchet surface ridges and notches, thereby achieving the simulated mechanical feel and sound, the handle pull may be stopped. If the handle is released at that point, it will not return to the start position since pin 20 lies in one of the deep notches 24 of the ratchet pawl surface, and due to their shape, they provide a very steep or reverse angle slope preventing return of the handle without being forced to the start position by the operator. Again, understanding that the machine will not be actuated until the handle is pulled to the position shown in FIG. 2 with arm 21 fully depressing microswitch lever 41, the machine will not be actuated. However, if the operator wants to return the handle to the start position, after he has pulled it enough so that pin 20 engages a portion of the ratchet pawl surface, he must push on the handle with sufficient force for pin 20 to be forced over the ratchet surface. However, the surface or angles between the ridges and notches should be such that although some resistance is offered, it is not such as to cause damage to the pawl or pin members, if the operator so desired to return it to the start position before fully pulling it.

It will be evident from the above description, that a simple, and yet effective mechanical simulating actuation assembly is provided for electric or electronically actuated coin machines, of various types. Such a simulation is satisfying to the operator, giving a sensation of mechanically selecting winning combinations of the device. The device may also be made for either right or left hand operation. These advantages as well as other modifications or embodiments of the invention within the purview of the concept described herein will be evident to those skilled in the art. The specific shapes and relationships of the various components of the apparatus may be varied, those shown being for the purpose of illustration only.

I claim:

1. In an electrically operated dispensing machine in which actuation is initiated by pulling a handle, the improvement of a device for simulating mechanical actuation comprising:

a ratchet member having a surface comprising a plurality of alternating ridges and notches;

a member for engaging said ratchet member surface comprising a pivotally mounted arm having a protuberance thereon for progressively engaging said ratchet member surface;

said ratchet member being secured for movement to engage said engaging member whereby said protuberance is urged along said ratchet member surface when said handle is pulled.

2. The device of claim 1 including a reciprocally movable mounting member secured to said handle for movement thereby, and on which ratchet member is pivotally mounted.

3. The device of claim 2 including a biasing spring for urging said handle and mounting member to a non-actuating position.

4. The device of claim 3 including means on said mounting member for electrically actuating said machine when said protuberance has reached the end of said ratchet surface.

* * * * *